US011717761B2

(12) United States Patent
Ouyang et al.

(10) Patent No.: US 11,717,761 B2
(45) Date of Patent: Aug. 8, 2023

(54) MOTION SIMULATOR

(71) Applicant: BROGENT TECHNOLOGIES INC., Kaohsiung (TW)

(72) Inventors: Chih-Hung Ouyang, Kaohsiung (TW); Yang-Chen Lin, New Taipei (TW); Zong-Yu Yu, Kaohsiung (TW); Ching-Wen Chuang, Kaohsiung (TW)

(73) Assignee: BROGENT TECHNOLOGIES INC., Kaohsiung (TW)

( * ) Notice: Subject to any disclaimer, the term of this patent is extended or adjusted under 35 U.S.C. 154(b) by 77 days.

(21) Appl. No.: 17/547,160

(22) Filed: Dec. 9, 2021

(65) Prior Publication Data

US 2022/0219093 A1 Jul. 14, 2022

(30) Foreign Application Priority Data

Jan. 8, 2021 (TW) ..... 110100843

(51) Int. Cl.
*A63G 31/16* (2006.01)
*A63G 31/02* (2006.01)

(52) U.S. Cl.
CPC ..... *A63G 31/16* (2013.01); *A63G 31/02* (2013.01)

(58) Field of Classification Search
CPC ..... A63G 31/00; A63G 31/02; A63G 31/04; A63G 31/16; G09B 9/00; G09B 9/02; G09B 9/04; G09B 9/10; G09B 9/12; G09B 9/14
USPC ..... 472/59–60, 130; 434/29, 55
See application file for complete search history.

(56) References Cited

U.S. PATENT DOCUMENTS 3,619,911 A * 11/1971 Pancoe ..... G09B 9/14 434/58
5,597,359 A * 1/1997 Byerly ..... A63G 31/16 472/60
6,077,078 A * 6/2000 Alet ..... F16M 11/18 472/130
10,668,395 B1 * 6/2020 Lee ..... A63G 31/02

* cited by examiner

*Primary Examiner* — Kien T Nguyen
(74) *Attorney, Agent, or Firm* — Winston Hsu

(57) ABSTRACT

A motion simulator comprises a base, a motion platform, a carrying platform, a support assembly and a driver assembly for simulating different motions. The motion platform is movably connected to the base, the carrying platform comprises a carrier arranged on the carrying platform, the support assembly is movably connected to the motion platform and the carrying platform, and the driver assembly drives the motion platform to move relative to the base and drives the actuator to actuate the carrying platform to move relative to the motion platform. The support assembly further includes an actuator and a support tube that are movably connected between the motion platform and the carrying platform, respectively.

15 Claims, 13 Drawing Sheets

MOTION SIMULATOR

BACKGROUND OF THE INVENTION

1. Field of the Invention

The present disclosure relates generally to a motion simulation technique, and more particularly to a motion simulator simulating different motions with a simple structure.

2. Description of the Prior Art

A motion simulator usually controls the movement of a seat so that a passenger on that seat is moved as well. When the movement of the seat is arranged to match particular visual content, the passenger can be tricked and believe that he is experiencing the motions within the visual content.

Steward platform is a common motion simulation platform formed by six telescoping actuators. Although the Steward platform is capable of simulating various motions, the movement of one telescoping actuator is dependent on the movements of other telescoping actuators, making it difficult to control the movement of desired motions. Further, the cost of the Steward platform is expensive since six telescoping actuators are required.

Some modifications of the motion simulation platform have been made. For example, in order to reduce the structure complexity, the motion simulation platform may be simplified by reducing the number of actuators to save the cost and reduce the control complexity. However, the simplified motion simulation platform can only offer limited motions, which makes it more difficult to create the desired motions corresponding to the visual content.

SUMMARY OF THE INVENTION

In view of the above, the present disclosure provides a motion simulator, and the motion simulator includes a base, a motion platform, a carrying platform, a support assembly and a driver assembly for simulating different motions.

In an embodiment, the motion platform is movably connected to the base, the carrying platform includes a carrier arranged on the carrying platform, the support assembly is movably connected to the motion platform and the carrying platform, and the driver assembly drives the motion platform to move relative to the base and drives the actuator to actuate the carrying platform to move relative to the motion platform. The support assembly further includes an actuator and a support tube that are movably connected between the motion platform and the carrying platform, respectively.

These and other objectives of the present invention will no doubt become obvious to those of ordinary skill in the art after reading the following detailed description of the preferred embodiment that is illustrated in the various figures and drawings.

DETAILED DESCRIPTION

One or more specific embodiments of the present disclosure will be described below. In an effort to provide a concise description of these embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

Figure 1:
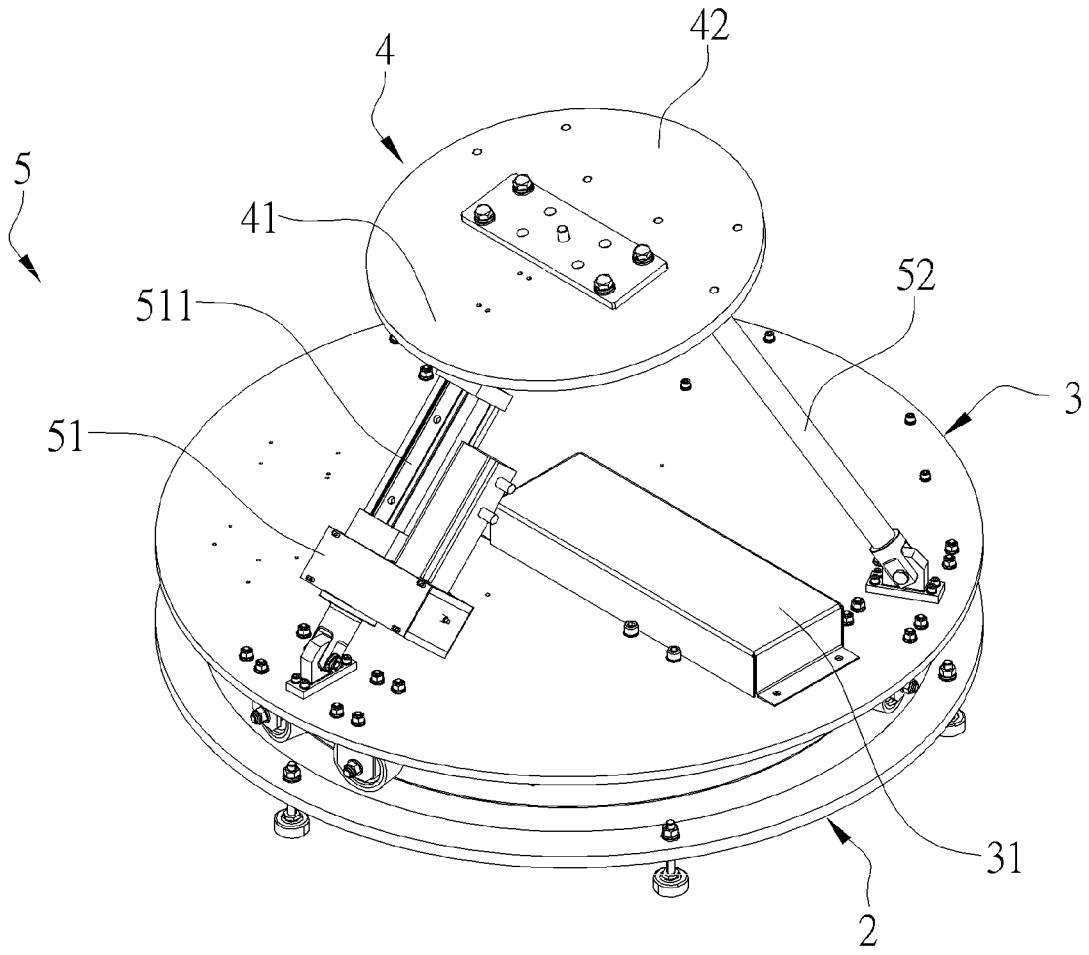
FIG. 1 is a schematic view of an exemplary motion simulator in accordance of an embodiment of the present disclosure.
Figure 2:
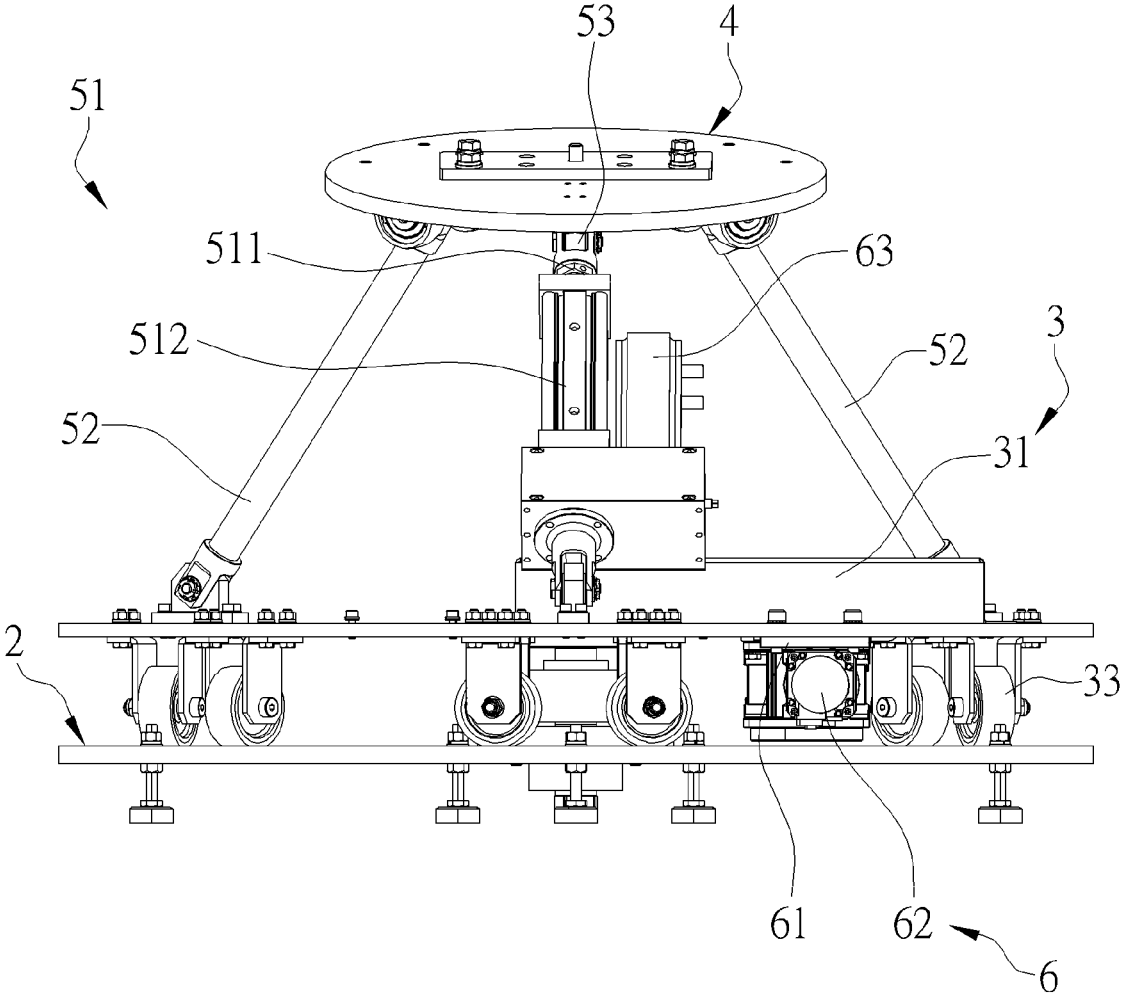
FIG. 2 is a front perspective view of the exemplary motion simulator in accordance of an embodiment of the present disclosure.
Figure 3:
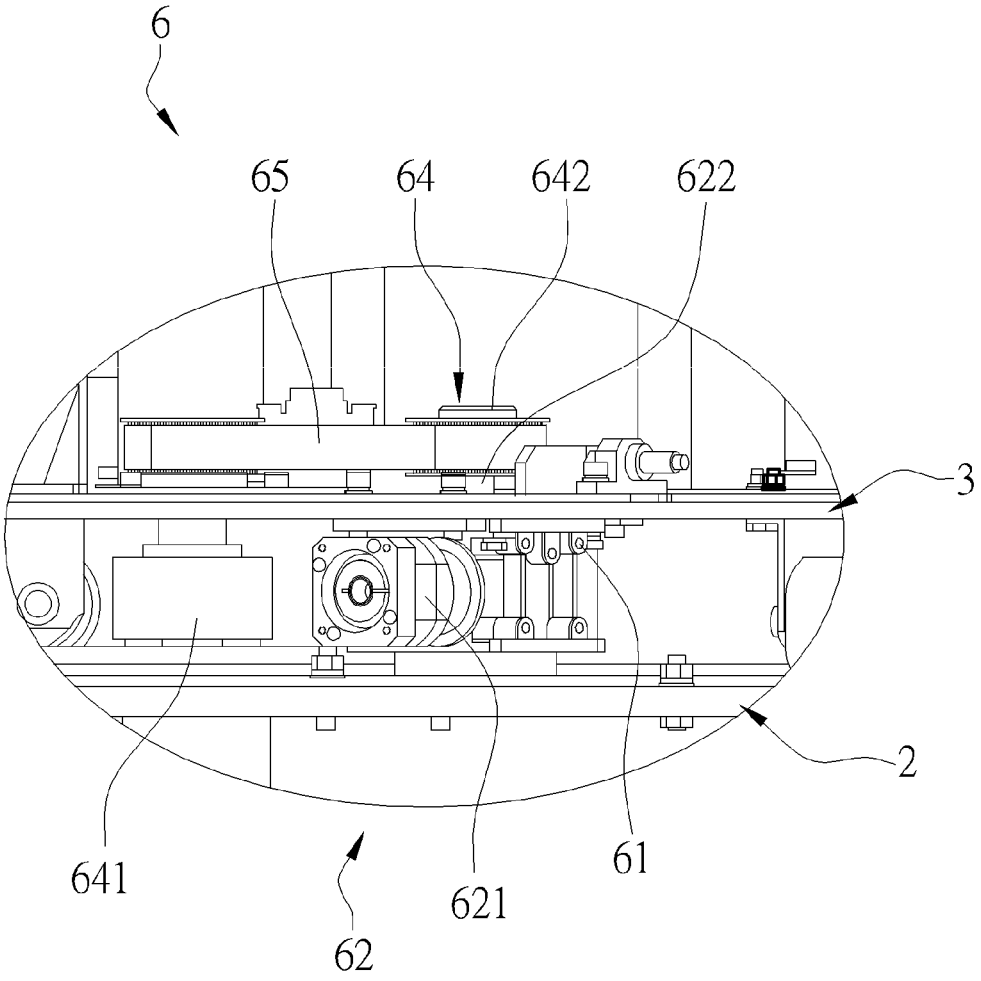
FIG. 3 is a partial lateral perspective view of a driver assembly of the exemplary motion simulator illustrated in FIG. 2.

Referring to FIGS. 1, 2 and 3, a motion simulator in accordance of an embodiment of the present disclosure is provided. The motion simulator includes a base 2, a motion platform 3, a carrying platform 4, a support assembly 5 and a driver assembly 6.

The base 2 is arranged on a horizontal plane. In an embodiment, the base 2 is stably arranged on the horizontal plane through a plurality of horizontal adjustment elements adjustable in height. The motion platform is movably connected to and above the base 2.

In an embodiment, the carrying platform 4 is arranged above and spaced apart from the motion platform 3. The carrying platform 4 includes a carrier (not shown) arranged thereon for receiving a passenger. In an embodiment, the carrier may be a chair but is not limited thereto. In an embodiment, a front end 41 and a rear end 42 opposite to the front end 41 are defined on the carrying platform 4. When a passenger sits on the carrier, the passenger faces toward the front end 41 of the carrying platform 4 with the passenger's back toward the rear end 42 of the carrying platform 4.

The support assembly 5 is movably connected between the motion platform 3 and the carrying platform 4, and the support assembly 5 includes at least one actuator 51 and at least one support tube 52. In an embodiment, lower ends of the actuator 51 and the support tube 52 are movably connected to the motion platform, respectively, and upper ends of the actuator 51 and the support tube 52 are movably connected to the carrying platform 4.

The actuator 51 includes a base portion 511 and an extension portion 512. The base portion 511 has a lower end pivotally connected to the motion platform 3, and the extension portion 512 has an upper end movably connected to the carrying platform 4. The extension portion 512 further has a lower end opposite to the upper end and the base portion 511 further has an upper end opposite to the lower end, and the lower end of the extension portion 512 is sleeved within the upper end of the base portion 511 so that the actuator 51 is telescopically extendible. In some embodiments, the actuator can be an oil cylinder, a pneumatic cylinder, an electric cylinder or other device capable of transforming energy into a controllable displacement.

In an embodiment, the support assembly 5 includes one of the actuator 51 and two of the support tubes 52, and the actuator 51 is arranged between the two support tubes 52. Moreover, upper ends of the actuator 51 and the support tubes 52 are pivotally connected to the carrying platform 4, respectively, to form a first triangular arrangement. Also, lower ends of the actuator 51 and the support tubes 52 are pivotally connected to the motion platform 3, respectively, to form a second triangular arrangement. In an embodiment, the projection area of the first triangular arrangement is smaller than the projection area of the second triangular arrangement.

In an embodiment, the upper end of the actuator 51 is pivotally connected to the carrying platform 4 through a first joint 53. Therefore, when the extension portion 512 of the actuator 51 moves with respect to the base portion 511 of the actuator 51 to extend or contract the actuator 51, the carrying platform 4 pivots about the first joint 53 to provide a pitch motion or a roll motion for a passenger sitting on the carrier.

The driver assembly 6 includes a motor mounting seat 61 arranged on the motion platform 3, a first motor assembly 62 arranged on the motor mounting seat 61, a second motor assembly 63 arranged on the actuator 51, and a rotary assembly 64 connected to the first motor assembly 62.

As shown in FIG. 3, the first motor assembly 62 includes a driving motor 621 arranged between the motion platform 3 and the base 2 and an output 622 arranged above the motion platform 3. Accordingly, the first motor assembly 62 controls the rotation of the motion platform 3 with respect to the base 2. In an embodiment, the rotary assembly 64 includes a fixed part 641 fixedly connected to the base 2 and a rotary part 642 fixedly connected to the motion platform 3 and being rotatable with respect to the fixed part 641. The output 622 is driven by the driving motor 621 to rotate, and rotates the rotary part 642 and the motion platform 3 with respect to the fixed part 641 and the base 2 through a transmission assembly 65.

In an embodiment, the fixed part 641 fixedly stands at the center of the base 2 and passes through an opening provided on the motion platform 3, so that the fixed part 641 protrudes above the opening of the motion platform 3. The rotary part 642 is connected to the first motor assembly 62 and is driven by the first motor assembly 62 to rotate. The transmission assembly 65 is arranged between the fixed part 641 and the rotary part 642, such that the first motor assembly 62 controls the motion platform 3 to rotate with respect to the base 2. In an embodiment, a housing 31 is arranged on the motion platform 3 to cover the fixed part 641, the rotary part 642 and the transmission assembly 65 in order to avoid accidental contact. In an embodiment, rotation wheels 33 are arranged between the motion platform 3 and the base 2. Therefore, when the transmission assembly 65 rotates the rotary part 642 along with the motion platform 3 with respect to the fixed part 641 and the base 2, the rotation wheels provide support during the rotation.

In an embodiment, the driver motor 621 is arranged on the lower surface of the motion platform 3 as shown in FIG. 2. The output 622 passes through the motion platform 3 to protrude upwardly, and the transmission assembly 65 is arranged between the output 622 and the fixed part 641. In an embodiment, the transmission assembly 65 is a belt transmission structure, such that the first motor assembly 62 drives the motion platform 3 to rotate horizontally with respect to the base 2.

In an embodiment, the second motor assembly 63 drives the extension portion 512 of the actuator 51 to move with respect to the base portion 511 of the actuator 51. When the extension portion 512 moves away from the base portion 511, the actuator 51 as a whole extends. When the extension portion 512 moves toward the base portion 511, the actuator 51 as a whole contracts. In an embodiment, an upper end of the actuator 51 is proximate to a front end 41 of the carrying platform 4, such that the actuator 51 controls the front end 41 of the carrying platform 4 to move in a pitch direction with respect to the motion platform 3. In an embodiment, the two support tubes 52 are oppositely arranged at a rear end 42 of the carrying platform 4.

When the extension portion 512 of the actuator 51 moves away from the base portion 511 to extend the actuator 51, the height of the front end 41 of the carrying platform 4 can be raised to provide the passenger a motion of flying up. When the extension portion 512 of the actuator 51 moves toward the base portion 511 to contract the actuator 51, the height of the front end 41 of the carrying platform 4 can be reduced to provide the passenger a motion of diving down. Therefore, the motion simulator can provide a pitch motion for the passenger by controlling the actuator 51.

Figure 4:
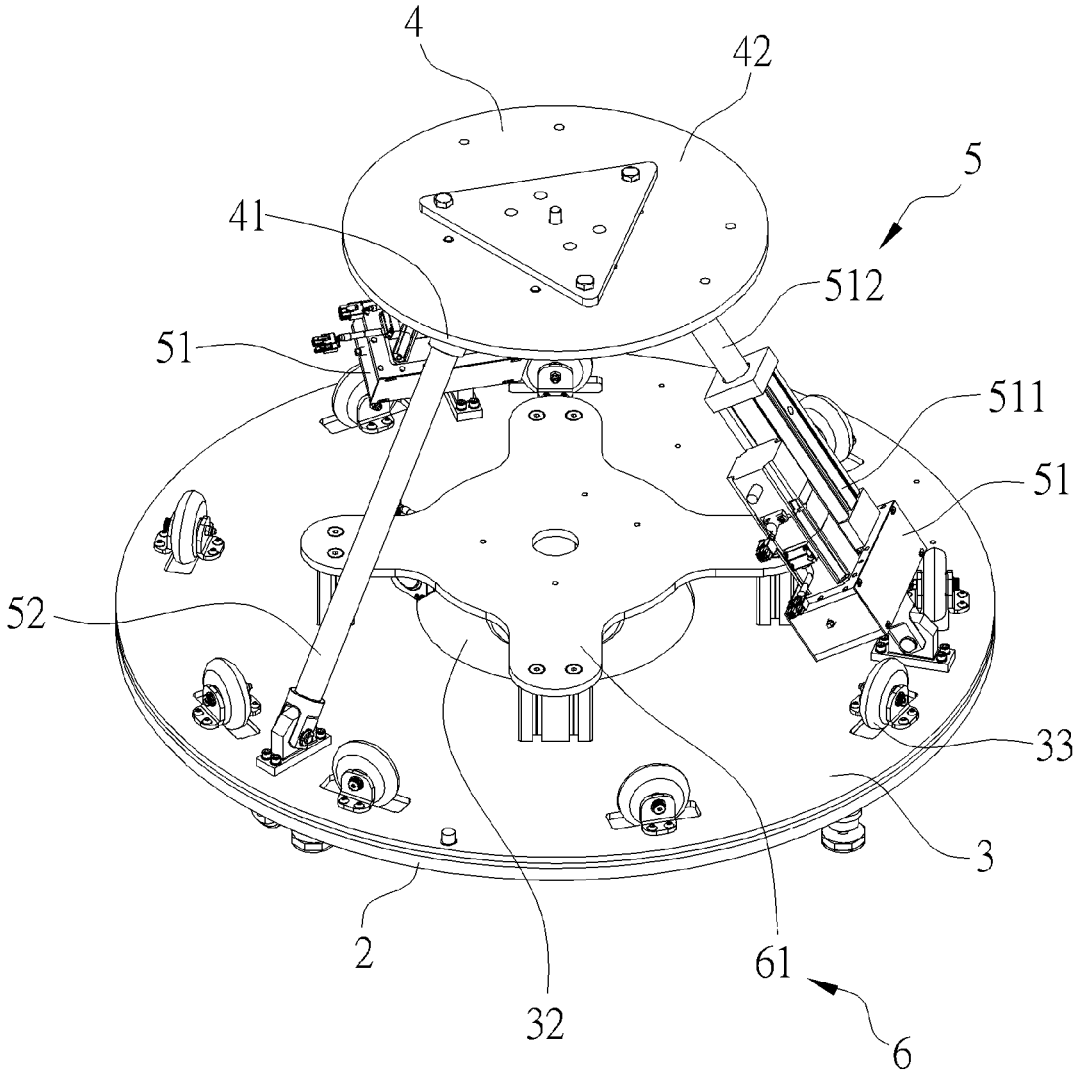
FIG. 4 is a schematic view of an exemplary motion simulator in accordance of an embodiment of the present disclosure.
Figure 5:
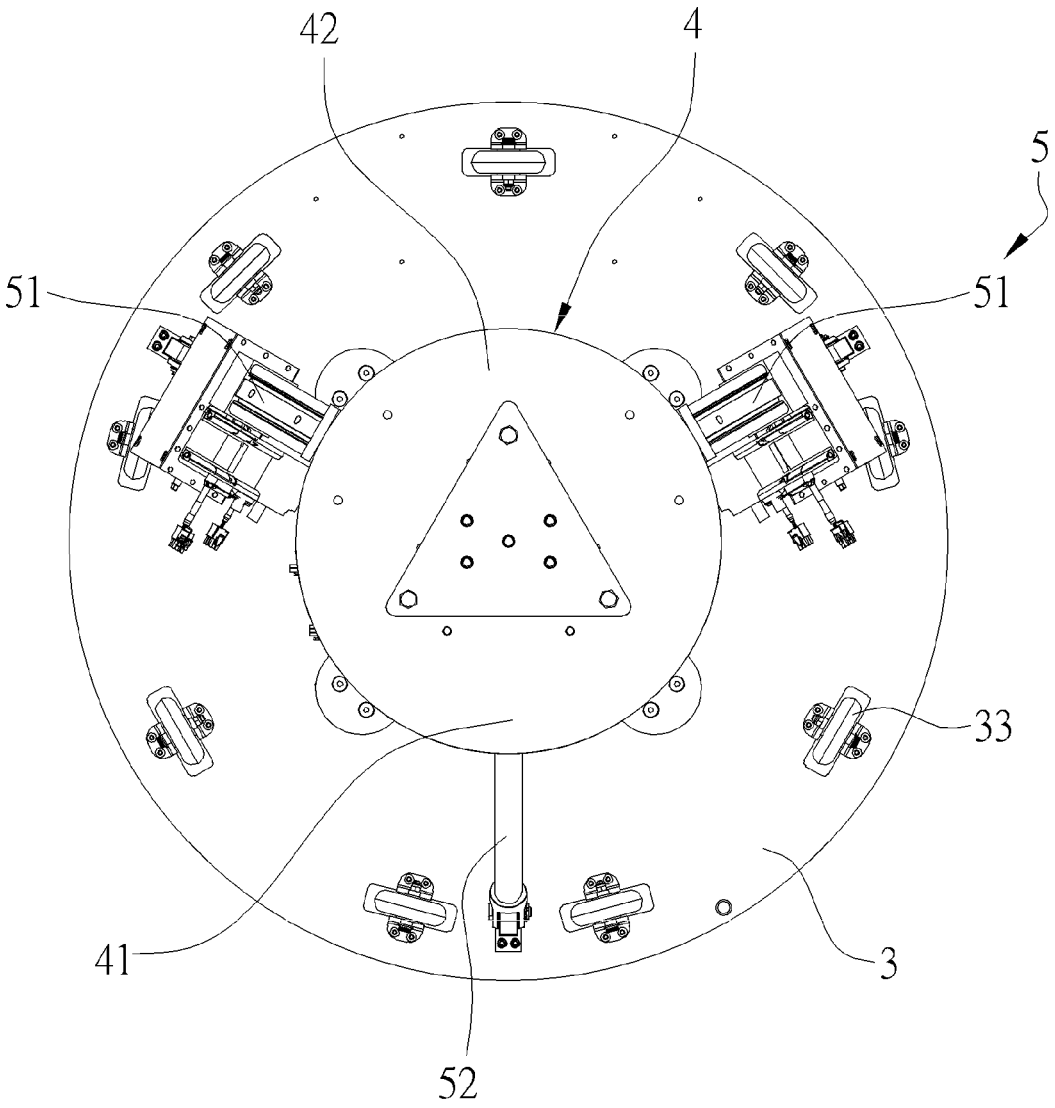
FIG. 5 is a top view of the exemplary motion simulator in accordance of an embodiment of the present disclosure.
Figure 6:
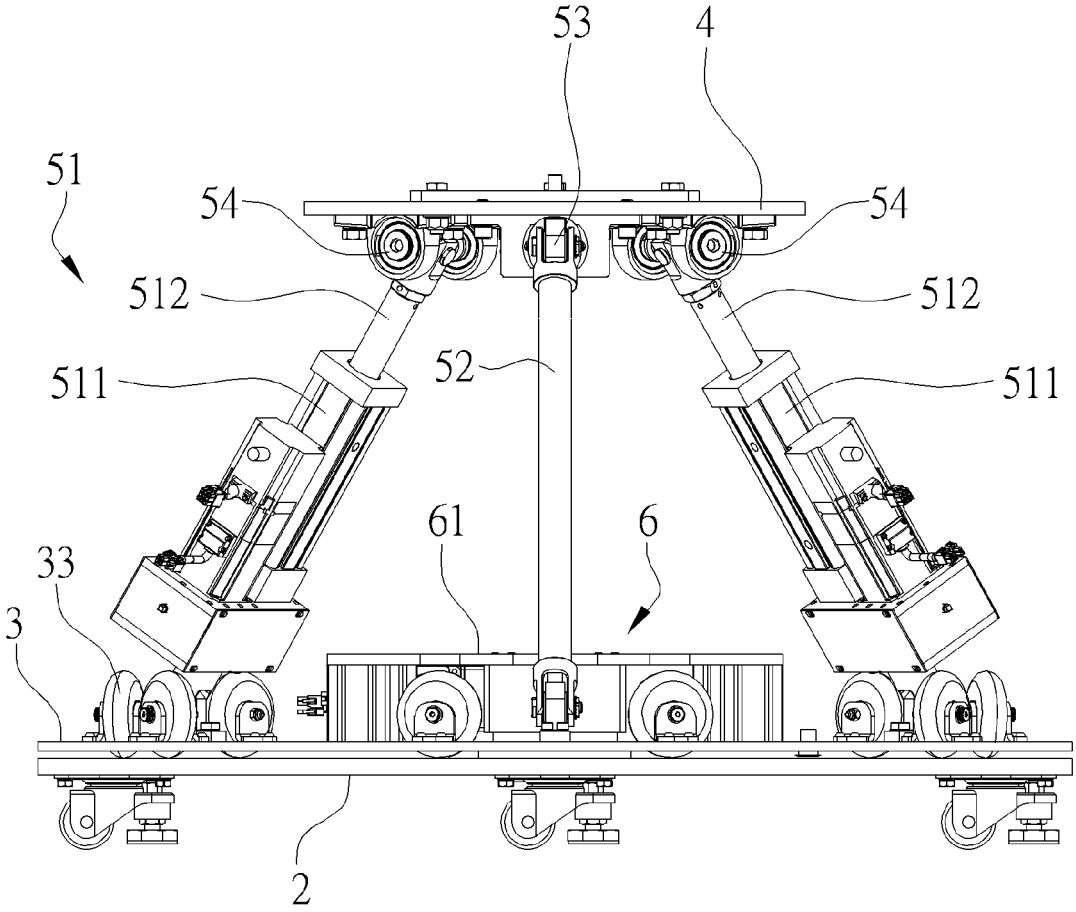
FIG. 6 is a front schematic view of the exemplary motion simulator in accordance of an embodiment of the present disclosure.

Referring to FIGS. 4, 5 and 6, a motion simulator of an embodiment is provided. As shown in FIG. 4, the motion simulator includes two actuators 51 and one support tube 52, and the support tube 52 is arranged between the two actuators 51.

The two actuators 51 are oppositely arranged at a rear end of the carrying platform 4, and the support tube 52 is arranged at a front end 41 of the carrying platform. In an embodiment, the upper end of the support tube 52 is pivotally connected to the carrying platform 4 through a first joint 53, and the upper ends of the two actuators 51 are pivotally connected to the carrying platform 4 through a second joint 54. When the extension portion 512 of the actuator 51 moves with respect to the base portions 511 to extend or contract the actuator 51, the carrying platform 4 pivots about the first joint 53 to provide a pitch motion or a roll motion for the passenger.

When the extension portion 512 of one actuator 51 moves away from the base portion 511 to extend and the extension portion 512 of another one actuator 51 moves toward the base portion 511 to contract, the carrying platform 4 provide a roll motion for the passenger.

When the extension portions 512 of the two actuators 51 move away from the respective base portions 511 in unison to extend or move toward the respective base portions 511 in unison to contract, the carrying platform 4 provides a pitch motion for the passenger.

In an embodiment, the first joint 53 and the two second joints 54 are arranged under the carrying platform to from a triangular arrangement. In an embodiment, the first joint 53 is arranged proximate to the front end 41 of the carrying platform 4, and the two second joints 54 are arranged proximate to the rear end 42 of the carrying platform 4. In an embodiment, pivot structures are arranged at lower ends of the support tube 52 and the two actuators 51, respectively, such that the support tube 52 and the two actuators 51 are pivotally connected to the motion platform 3. As shown in FIG. 4, the pivot structures form a triangular arrangement.

Figure 7:
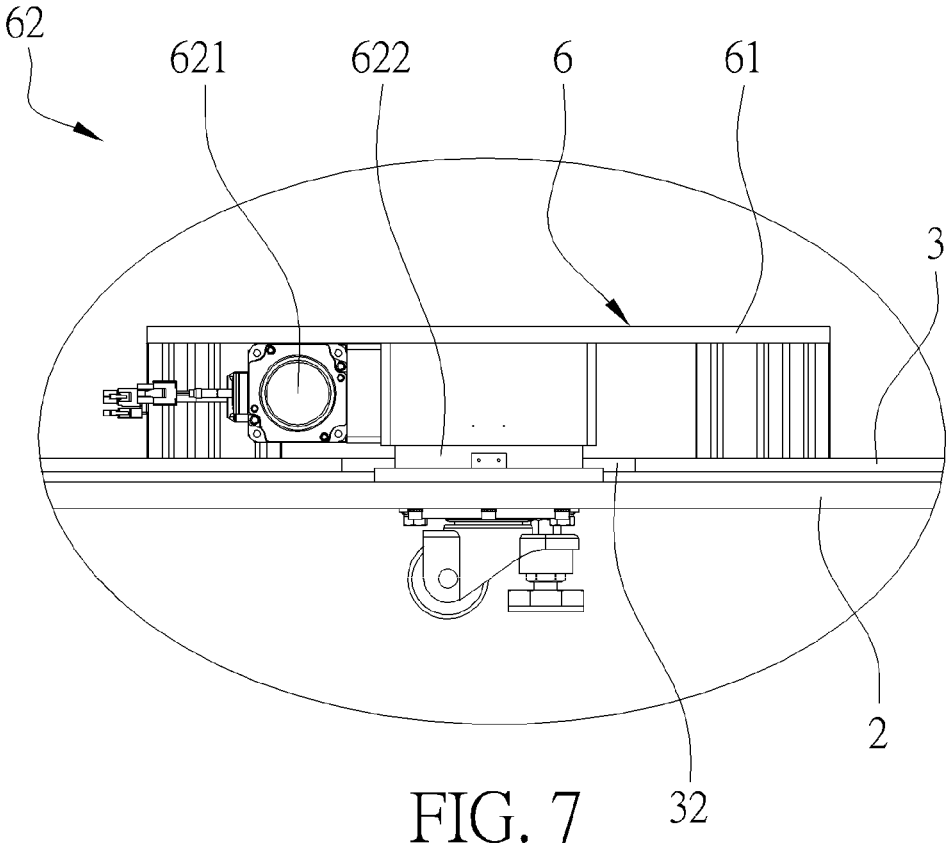
FIG. 7 is a partial lateral perspective view of a driver assembly of the exemplary motion simulator illustrated in FIG. 6.
Figure 8:
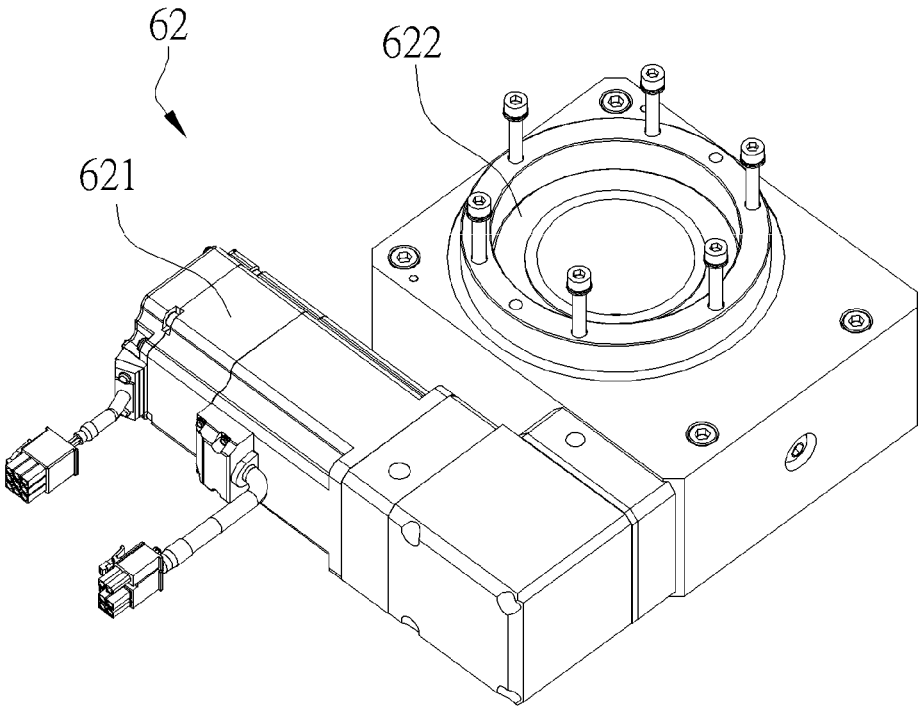
FIG. 8 is a partial schematic perspective view of a motor assembly of the driver assembly illustrated in FIG. 7.

Referring to FIGS. 7 and 8, the driver assembly 6 includes a motor mounting seat 61 and a first motor assembly 62. The motor mounting seat 61 is fixedly arranged on the motion platform 3 and the first motor assembly 62 is hung at the motor mounting seat 61.

In an embodiment, the first motor assembly 62 includes a driving motor 621 hung at the motor mounting seat 61 and an output 622 fixedly connected to the base 2. The output 622 is driven by the driving motor 621 to rotate so as to rotate the motion platform 3 with respect to the base 2.

It should be noted that in the embodiment shown in FIGS. 7 and 8, the arrangement position of the first motor assembly 62 is no longer between the base 2 and the motion platform 3, but above the motion platform 3. Therefore, the distance between the base 2 and the motion platform 3 can be reduced to effectively lower the arrangement height of the motion platform 3. Consequently, the overall height of the motion simulator is reduced for conveniently loading the passenger. Moreover, the center of gravity of the motion simulator is lowered as well, so that the structure of the motion simulator is more stable and the risk of turning over can be further reduced. Additionally, in an embodiment, the first motor assembly 62 is arranged at a center position of the motion platform 3 to minimize the entire structure of the motion simulator. Also, since the first motor assembly 62 is hung within the motor mounting seat 61, the first motor assembly 62 is not exposed to avoid accidental contact. With the arrangement mentioned above, the space above the motion platform 3 is used in a more efficient manner and the motion simulator is more compact.

In an embodiment, the first motor assembly 62 is a hollow rotary table, and the motion platform 3 has an opening 32 arranged thereon. The output 622 of the hollow rotary table passes through the opening 32 of the motion platform 3 and is fixedly connected to the base 2.

Figure 9:
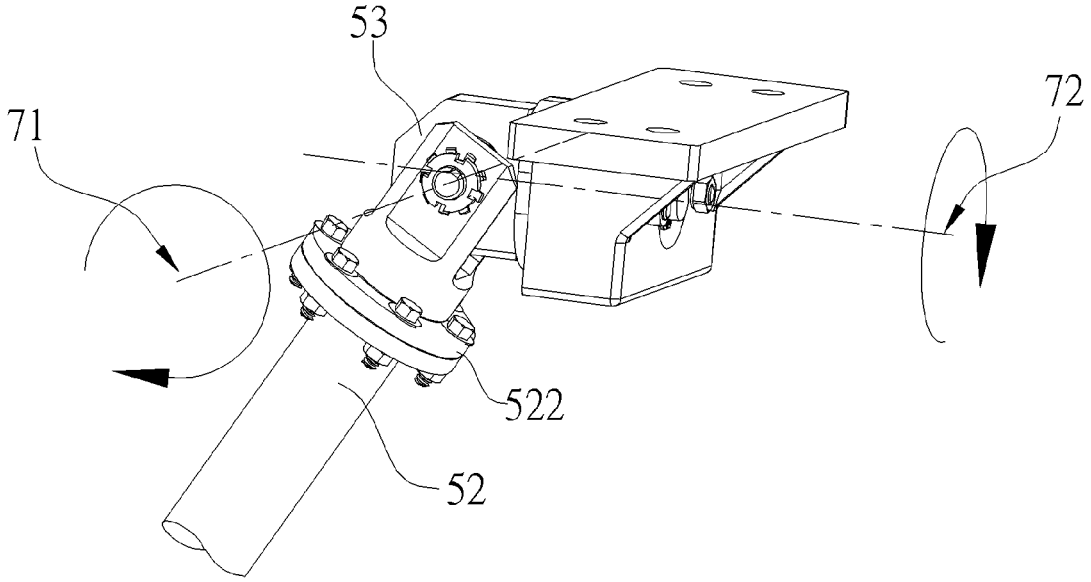
FIG. 9 is a partial schematic perspective view of a first joint of a support assembly in accordance of an embodiment of the present disclosure.

Referring to FIG. 9, the upper end of the support tube 52 is pivotally connected to the first joint 53 about a first horizontal axis 71, and the first joint 53 is pivotally connected to the carrying platform 4 about a second horizontal axis 72. In an embodiment, the first horizontal axis 71 is substantially perpendicular to the second horizontal axis 72. When the carrying platform 4 moves about the first horizontal axis 71, a pitch motion is generated. When the carrying platform 4 moves about the second horizontal axis 72, a roll motion is generated.

Figure 10:
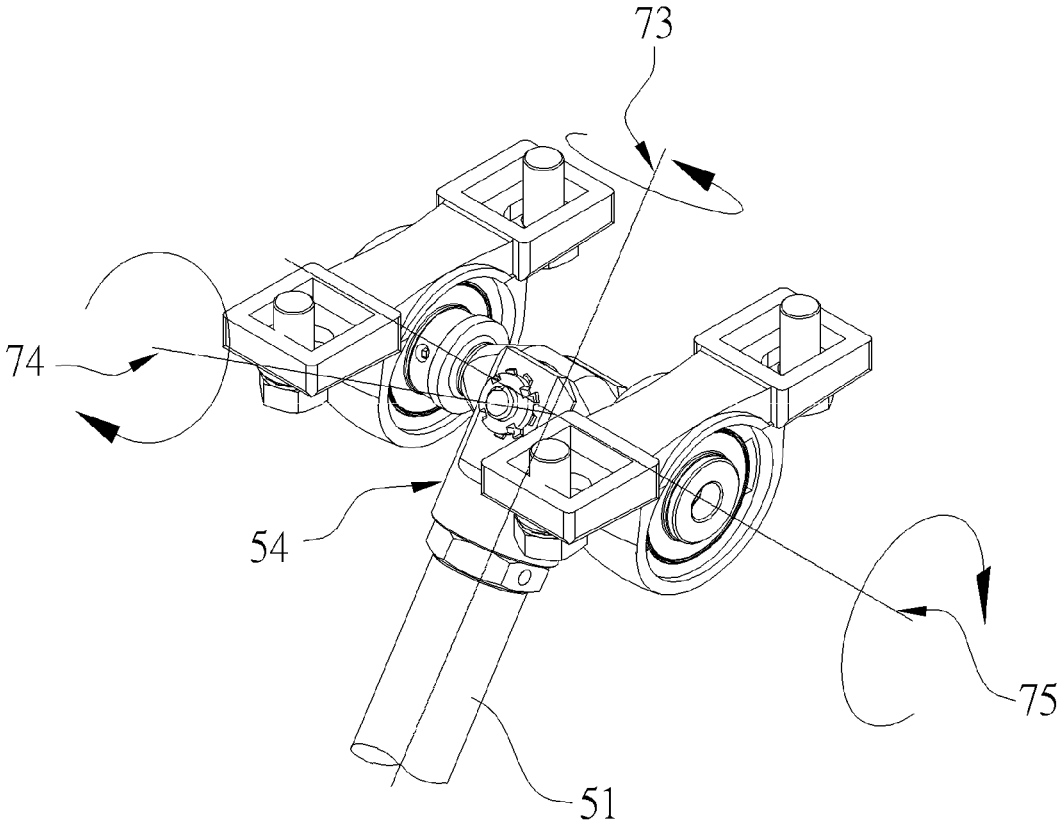
FIG. 10 is a partial schematic perspective view of a second joint of a support assembly in accordance of an embodiment of the present disclosure.

Referring to FIG. 10, the actuator 51 is connected to a second joint 54. In an embodiment, the second joint 54 is an universal bearing structure having three degrees of freedom contributed by a first rotation unit 73, a second rotation unit 74 and a third rotation unit 75, respectively. In an embodiment, the first rotation unit 73, the second rotation unit 74 and the third rotation unit 75 rotate about three axes substantially perpendicular to each other, respectively.

Figure 11:
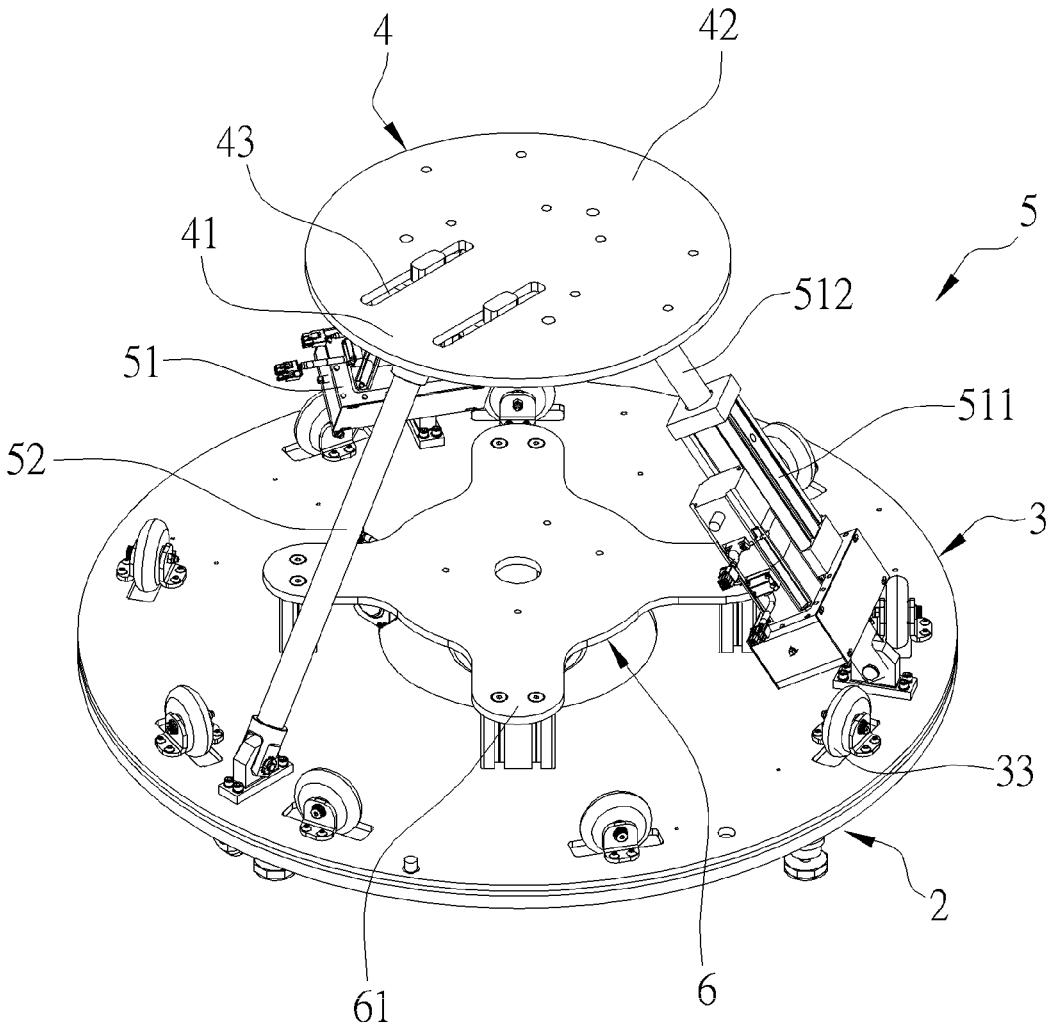
FIG. 11 is a schematic view of an exemplary motion simulator in accordance of an embodiment of the present disclosure.
Figure 12:
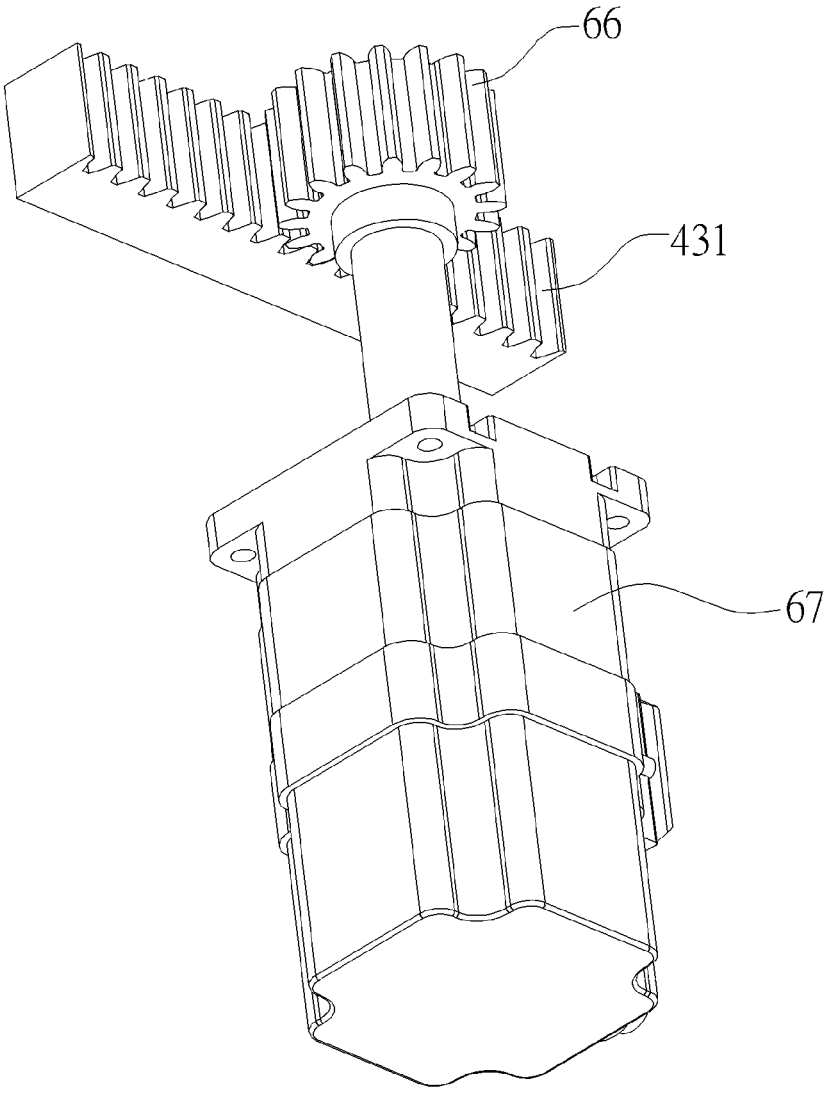
FIG. 12 is a partial schematic view of a slide slot arranged on a carrying platform in accordance of an embodiment of the present disclosure.

Referring to FIGS. 11 and 12, in an embodiment, a slide slot 43 is arranged under the carrying platform 4 along a front-rear direction of the carrying platform 4. The slide slot 43 receives the upper end of the support tube 52 so that the upper end of the support tube 52 is slidably arranged in the slide slot 43.

The upper end of the support tube 52 is arranged with a gear 66 and a third motor assembly 67 for driving the gear 66. The slide slot 43 is arranged with a geared structure 431 corresponding to the gear 66, such that the third motor assembly 67 controls the upper end of the support tube 52 to move along the slide slot 43.

In an embodiment, the geared structure 431 is a gear rack engageable under the carrying platform 4. For example, the gear rack can be engaged on a lower surface of the carrying platform 4 proximate to the slide slot 43. In an embodiment, the geared structure 431 can be gear teeth integrally formed on sidewalls of the slide slot 43.

In an embodiment, the third motor assembly 67 and the first joint 53 are fixed together, and the gear 66 is engaged to the geared structure 431 with a gear connection. Therefore, the third motor assembly 67 controls the movement of the gear 66 on the geared structure 431, thereby controls the position of the upper end of the support tube 52 under the carrying platform 4.

Figure 13:
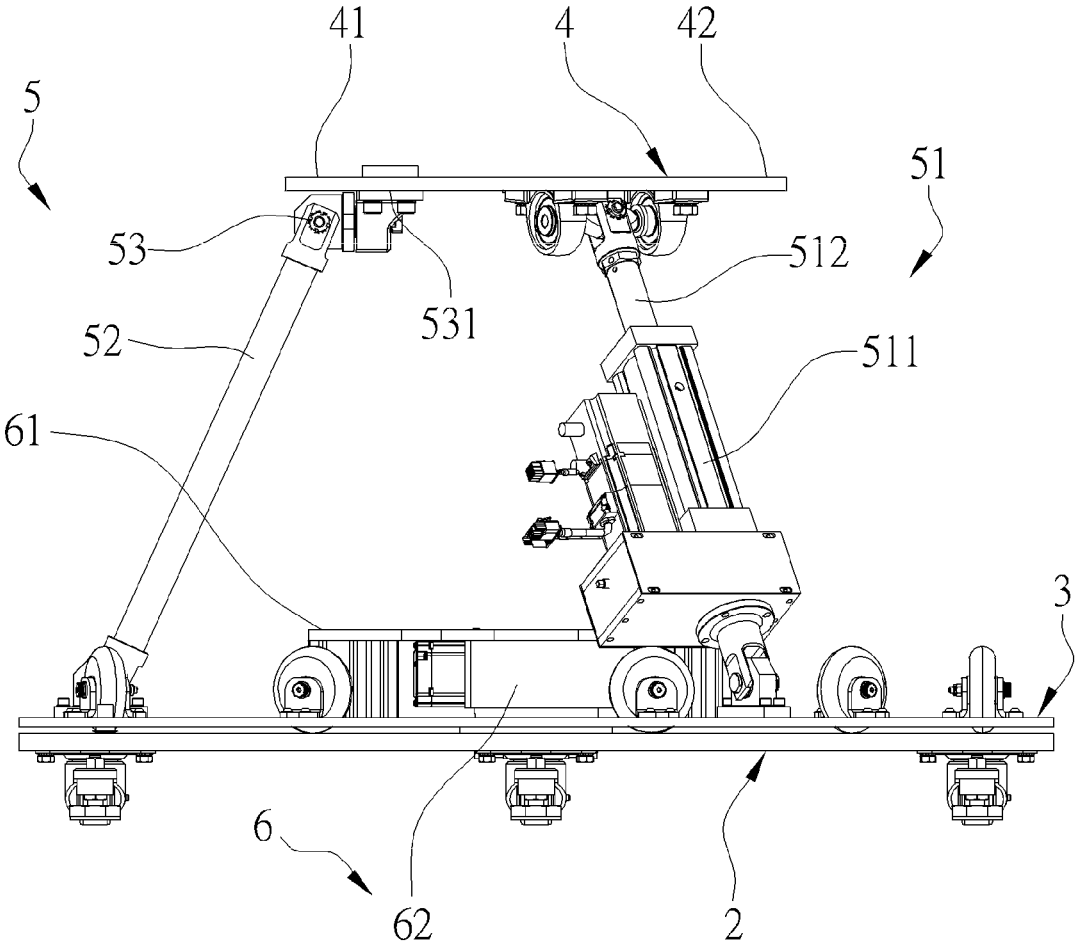
FIG. 13 is a lateral schematic view of a support tube having an end proximate to a front end of a carrying platform in accordance of an embodiment of the present disclosure.

Referring to FIG. 13, the upper end of the support tube 52 is pivotally connected to the first joint 53 about a first horizontal axis, and the first joint 53 is pivotally connected to the carrying platform 4 about a second horizontal axis. The first joint 53 has an extension surface 531 proximate to a pivot connection between the first joint 53 and the carrying platform 4, and the gear 66 is rotatably arranged between the extension surface 531 and the geared structure 431 of the slide slot 43. In an embodiment, the extension surface 531 is slidably connected under the carrying platform 4. Therefore, when the gear 66 is controlled by the third motor assembly 67 to move along the slide slot 43, the upper end of the actuator 51, the first joint 53 and the extension surface 531 together slide under the carrying platform 4 in unison.

Referring to FIG. 13, the extension portions 512 of the two actuators 51 move in unison away from the base portions 511 thereof, respectively, to extend the two actuators 51. Meanwhile, the upper end of the support tube 52 slides to the front end 41 of the carrying platform 4 along the slide slot 43. Accordingly, the carrying platform 4 moves upward in a heave direction. In an embodiment, after the motion platform 4 is moved upward, the distance between the upper end of the support tube 52 and the center of the carrying platform 4 is approximately 111.8 mm and the distance between the carrying platform 4 and the motion platform 3 is approximately 496.5 mm. However, the present invention is not limited thereto.

Figure 14:
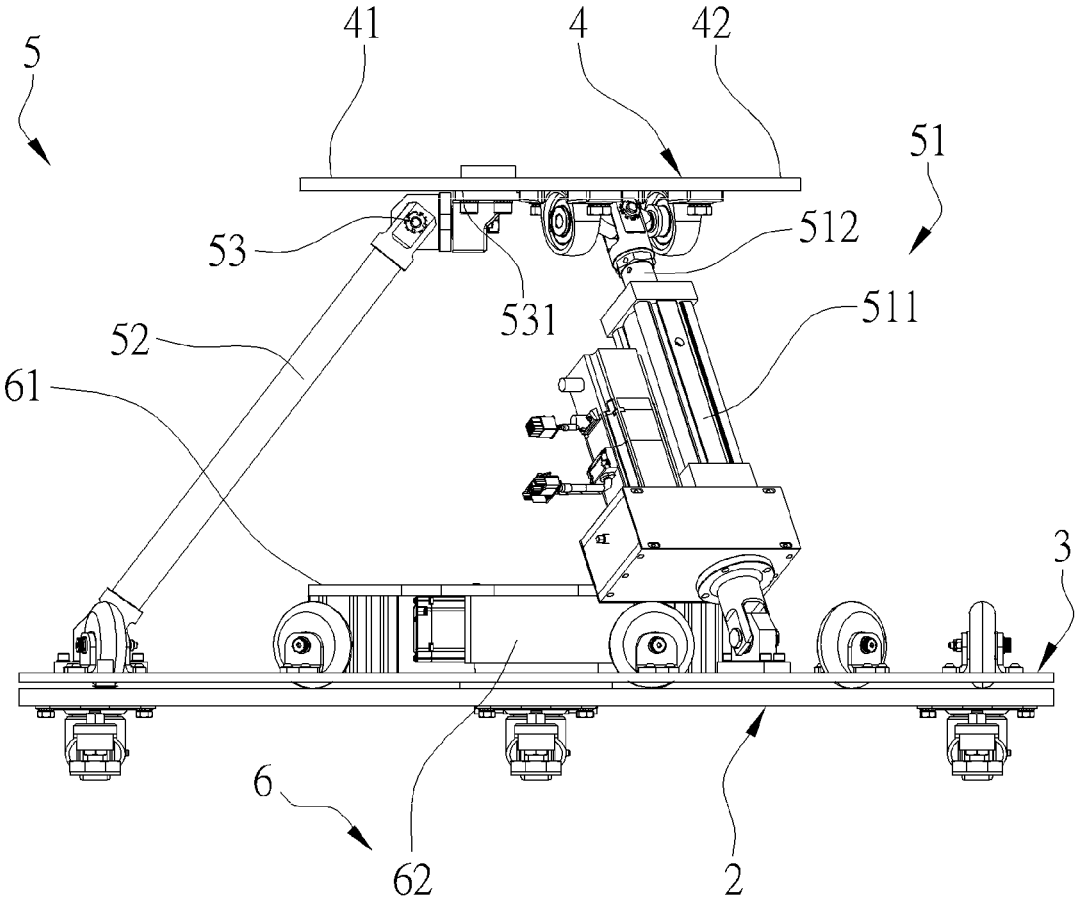
FIG. 14 is a lateral schematic view of a support tube having an end proximate to a rear end of a carrying platform in accordance of an embodiment of the present disclosure.

Referring to FIG. 14, the extension portions 512 of the two actuators 51 move in unison toward the base portions 511 thereof, respectively, to contract. Meanwhile, the upper end of the support tube 52 slides to the rear end 42 of the carrying platform 4 along the slide slot 43. Accordingly, the carrying platform 4 moves downward in the heave direction. In an embodiment, after the motion platform 4 is moved downward, the distance between the upper end of the support tube 52 and the center of the carrying platform 4 is 79.3 mm and the distance between the carrying platform 4 and the motion platform 3 is 463.2 mm but not limited thereto.

It should be noted that the third motor assembly 67 can also control the position of the gear 66 on the geared structure 431 to independently control the height of the front end 41 of the carrying platform 4. Since the two actuators 51 can control the height of the rear end 42 of the carrying platform 4 and the rolling degree, the motion simulation provides various motion combinations controlled by the third motor assembly 67 and the actuators 51.

Figure 15:
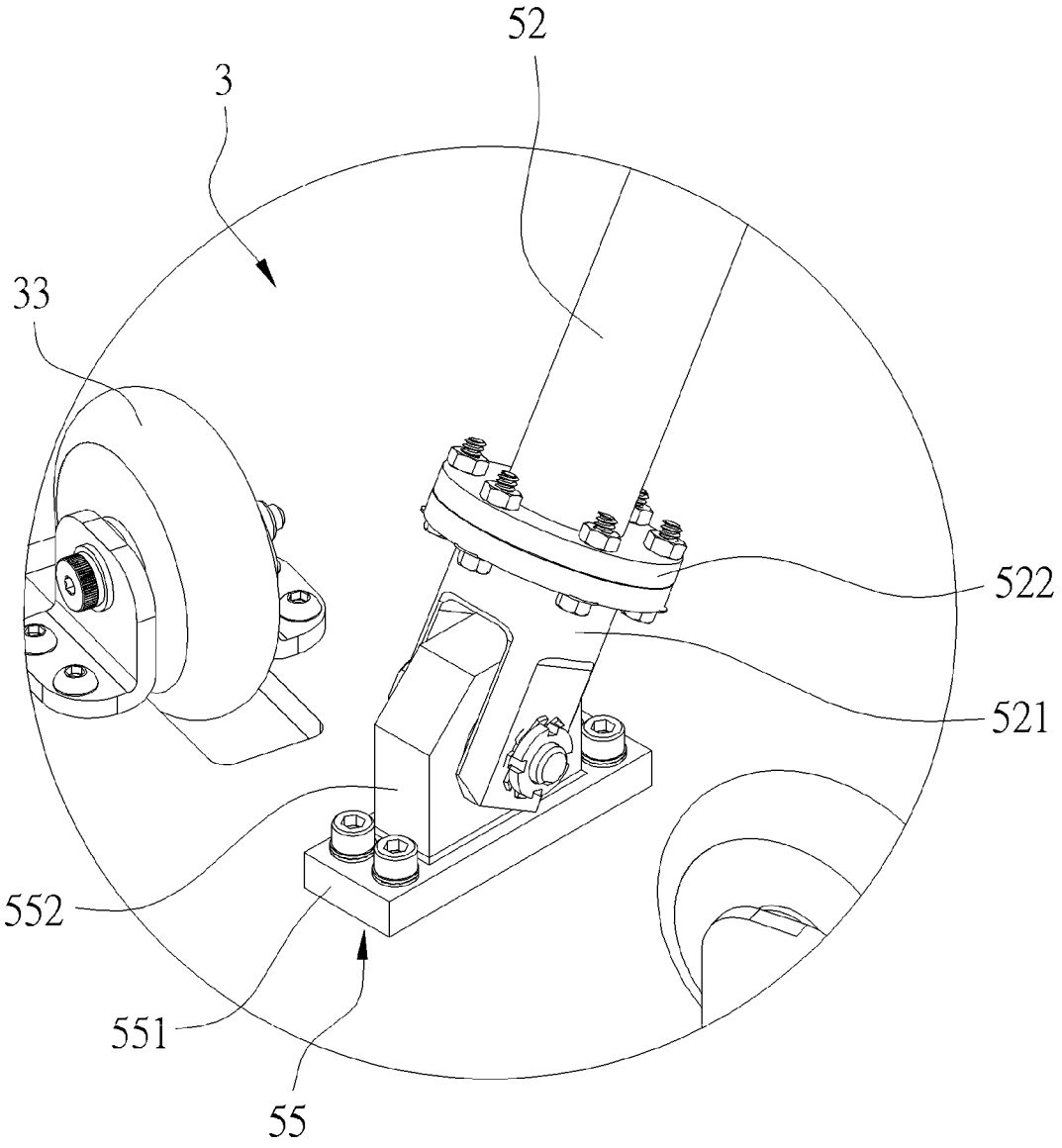
FIG. 15 is a partial schematic view of a third joint arranged between a support tube and a motion platform in accordance of an embodiment of the present disclosure.

Now referring to FIG. 9 in conjunction with FIG. 15, in an embodiment, a third joint 55 is arranged between the support tube 52 and the motion platform 3. The third joint 55 includes a fixed part 551 fixed on the motion platform 3 and a pivot part 552 connected to the fixed part 551. The lower end of the support tube 52 is disposed within an arrangement part 521, and a flange structure 522 is arranged between the lower end of the support tube 52 and the arrangement part 521 to prevent the lower end of the support tube 52 from rotating with respect to the arrangement part 521. Moreover, another flange structure 522 is arranged between the upper end of the support tube 52 and the first joint 53 to prevent the upper end of the support tube 52 from rotating with respect to the first joint 53. Therefore, when the two actuators 51 are operated to extend or contract, the lower end of the support tube 52 does not rotate with respect to the arrangement part 521, such that unnecessary and uncontrollable displacements can be avoided. The support tube 52 is further pivotally connected to the pivot part 552 of the third joint 55 through the arrangement part 521 so that the support tube 52 is pivotable with respect to the motion platform. It should be noted that the third joint 55 may be other pivot structure and is not limited to the embodiment mentioned above.

Given the description above, the motion simulator according to the present disclosure provide a simple structure with the support assembly 5 formed by two actuators 51 and one support tube 52 or formed by one actuator 51 and two support tubes 52. Accordingly, various motions can be simulated with a rather simple structure. In addition, since the motion platform 3 is horizontally rotatable with respect to the base 2, the yaw motion can be achieved without complicated control mechanism. Since the front end 41 and the rear end 42 of the carrying platform 4 can be controlled to raise or descend concurrently or independently, the motion simulator thus provides convincing roll motion and pitch motion.

For example, when the passenger sits on the carrier of the carrying platform 4 and faces forward, the actuator 51 is controlled to provide roll motion and pitch motion, and the rotation of the motion platform 3 with respect to the base 2 is controlled to provide yaw motion.

In addition, the third motor assembly 67 controls the position of the gear 66 on the geared structure 431 so as to control the height at the front end 41 of the carrying platform. Therefore, various motions can be achieved by the motion simulator of the present disclosure with a rather simple structure as compared with a traditional Steward platform.

It must be noted that the embodiments described above are only embodiments of the present disclosure. All equivalent structures which employ the concepts disclosed in this specification and the appended claims should fall within the scope of the present disclosure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A motion simulator, comprising:

a base;

a motion platform movably connected to the base;

a carrying platform, comprising a carrier arranged on the carrying platform;

a support assembly movably connected to the motion platform and the carrying platform, wherein the support assembly further comprises:

an actuator having a first end movably connected to the motion platform and a second end movably connected to the carrying platform; and a support tube having a first end movably connected to the motion platform and a second end movably connected to the carrying platform; and one of the actuator and the support tube cooperatively supports the carrying platform; and a driver assembly for driving the motion platform to move relative to the base and driving the actuator to actuate the carrying platform to move relative to the motion platform;

wherein the actuator comprises a base portion and an extension portion, the base portion has a first end pivotally connected to the motion platform and a second end opposite to the first end of the base portion, the extension portion has a first end movably connected to the carrying platform and a second end opposite to the first end of the extension portion, and the second end of the extension portion is sleeved within the second end of the base portion such that the second end of the extension portion is telescopically extendible with respect to the second end of the base portion;

wherein the first end of the actuator is pivotally connected to the carrying platform by a first joint, such that when the extension portion of the actuator extends or contracts, the carrying platform pivots about the first joint;

wherein the support assembly includes one of the actuator and two of the support tubes, and the actuator is arranged between the two support tubes;

wherein the driver assembly further comprises:

a motor mounting seat fixedly arranged on the motion platform; and a motor assembly hung at the motor mounting seat, wherein the motor assembly includes a driving motor hung at the motor mounting seat and an output fixedly connected to the base, the output is driven by the driving motor to rotate so as to rotate the motion platform with respect to the base.

2. The motion simulator of claim 1, wherein the two support tubes are arranged oppositely at an rear end of the carrying platform and the actuator is arranged at a front end of the carrying platform, when the carrying platform moves in a pitch direction, the extension portion of the actuator moves away from the base portion of the actuator to extend or move toward the base portion of the actuator to contract.

3. The motion simulator of claim 1, wherein the motor assembly is a hollow rotary table and the motion platform has an opening arranged thereon, and the output of the hollow rotary table passes through the opening of the motion platform and is fixedly connected to the base.

4. The motion simulator of claim 1, wherein the driver assembly further comprises:

a motor assembly fixedly arranged on the base; and a rotary assembly having a fixed part fixedly connected to the base and a rotary part fixedly connected to the motion platform and being rotatable with respect to the fixed part, wherein the motor assembly includes a driving motor arranged between the motion platform and the base and an output arranged above the motion platform, the output is driven by the driving motor to rotate, and rotates the rotary part and the motion platform with respect to the fixed part and the base through a transmission assembly.

5. The motion simulator of claim 1, wherein the support tube is pivotally connected to the carrying platform by a first joint, such that when the extension portion of the actuator extends or contracts, the carrying platform pivots about the first joint.

6. The motion simulator of claim 5, wherein the support assembly includes two of the actuators and one of the support tube, and the support tube is arranged between the two actuators, such that when the carrying platform moves in a roll direction, the extension portion of one of the two actuators moves away from the base portion thereof to extend and the extension portion of another one of the two actuators moves toward the base portion thereof to contract.

7. The motion simulator of claim 6, wherein the two actuators are arranged oppositely at a rear end of the carrying platform and the support tube is arranged at a front end of the carrying platform, when the carrying platform moves in a pitch direction, the extension portions of the two actuators move in unison away from the base portions thereof, respectively, to extend or move in unison toward the base portions thereof, respectively, to contract.

8. The motion simulator of claim 7, wherein the second end of the support tube is pivotally connected to the first joint about a first horizontal axis and the first joint is further pivotally connected to the carrying platform about a second horizontal axis, wherein the first horizontal axis is substantially perpendicular to the second horizontal axis, the carrying platform pivots about the first horizontal axis when the carrying platform moves in the pitch direction, and the carrying platform pivots about the second horizontal axis when the carrying platform moves in the roll direction.

9. The motion simulator of claim 8, wherein the actuator is pivotally connected to the carrying platform by a second joint having three degrees of freedom that rotate about three axes substantially perpendicular to each other, respectively.

10. The motion simulator of claim 7, wherein the carrying platform has a slide slot arranged under the carrying platform along a front-rear direction of the carrying platform, the slide slot receives the second end of the support tube so that the second end of the support tube is slidably arranged in the slide slot, when the carrying platform moves in a heave direction, the extension portions of the two actuators move in unison away from the base portions thereof, respectively, to extend and the second end of the support tube slides to the front end of the carrying platform, or the extension portions of the two actuators move in unison toward the base portions thereof, respectively, to contract and the second end of the support tube slides to the rear end of the carrying platform.

11. The motion simulator of claim 10, wherein the second end of the support tube is arranged with a gear and a motor assembly for driving the gear, and the slide slot is arranged with a geared structure corresponding to the gear, such that the motor assembly controls the second end of the support tube to move along the slide slot.

12. The motion simulator of claim 11, wherein the second end of the support tube is pivotally connected to the first joint about a first horizontal axis, and the first joint is further pivotally connected to the carrying platform about a second horizontal axis, the first joint has an extension surface adjacent the second horizontal axis, and the gear is rotatably arranged between the extension surface and the geared structure of the slide slot.

13. The motion simulator of claim 5, wherein the driver assembly further comprises:

a motor mounting seat fixedly arranged on the motion platform; and a motor assembly hung at the motor mounting seat, wherein the motor assembly includes a driving motor hung at the motor mounting seat and an output fixedly connected to the base, the output is driven by the driving motor to rotate so as to rotate the motion platform with respect to the base.

14. The motion simulator of claim 13, wherein the motor assembly is a hollow rotary table and the motion platform has an opening arranged thereon, and the output of the hollow rotary table passes through the opening of the motion platform and is fixedly connected to the base.

15. The motion simulator of claim 5, wherein the driver assembly further comprises:

a motor assembly fixedly arranged on the base; and a rotary assembly having a fixed part fixedly connected to the base and a rotary part fixedly connected to the motion platform and being rotatable with respect to the fixed part, wherein the motor assembly includes a driving motor arranged between the motion platform and the base and an output arranged above the motion platform, the output is driven by the driving motor to rotate, and rotates the rotary part and the motion platform with respect to the fixed part and the base through a transmission assembly.

* * * * *